US005135081A

United States Patent [19]

Watt et al.

[11] Patent Number: 5,135,081

[45] Date of Patent: Aug. 4, 1992

[54] ELEVATOR POSITION SENSING SYSTEM USING CODED VERTICAL TAPE

[75] Inventors: Richard E. Watt, Spring Valley; Willilam R. Hoelscher, El Cajon; John H. Parker, San Diego, all of Calif.

[73] Assignee: United States Elevator Corp., San Diego, Calif.

[21] Appl. No.: 694,062

[22] Filed: May 1, 1991

[51] Int. Cl.[5] ..... B66B 3/02

[52] U.S. Cl. ..... 187/134

[58] Field of Search ..... 187/116, 134

[56] References Cited

U.S. PATENT DOCUMENTS

| | | | |
|---|---|---|---|
| 2,840,188 | 6/1958 | Savage | 187/29 |
| 3,406,846 | 10/1968 | O'Connor | 214/16.4 |
| 3,414,088 | 12/1968 | Burns et al. | 187/29 |
| 3,483,950 | 12/1969 | Simpson | 187/29 |
| 3,815,711 | 6/1974 | Hoelscher | 187/29 |
| 3,856,116 | 12/1974 | Savage | 187/28 |
| 3,889,231 | 6/1975 | Tosato et al. | 340/21 |
| 3,963,098 | 6/1976 | Lewis et al. | 187/134 |
| 4,019,606 | 4/1977 | Caputo et al. | 187/29 |
| 4,203,506 | 5/1980 | Richmon | 187/29 |
| 4,218,671 | 8/1980 | Lewis | 340/21 |
| 4,245,721 | 1/1981 | Masel | 187/29 |
| 4,427,095 | 1/1984 | Payne et al. | 187/29 |
| 4,433,756 | 2/1984 | Caputo et al. | 187/134 |
| 4,434,874 | 3/1984 | Caputo | 187/116 |
| 4,750,592 | 6/1988 | Watt | 187/134 |

*Primary Examiner*—A. D. Pellinen
*Assistant Examiner*—Lawrence E. Colbert
*Attorney, Agent, or Firm*—Brown, Martin, Haller & McClain

[57] ABSTRACT

A position sensing system includes a coded tape vertically mounted in an elevator shaft and a sensor unit mounted on an elevator car to detect code indicia on the tape. The sensor unit is connected to output circuitry for converting the sensor outputs to elevator position data for transmission to an elevator controller. The tape has two parallel tracks of indicia extending along its length. The first track comprises a pseudo-random code sequence which is non-repeating along any N successive bits for the length of the tape, and the sensor unit includes a first set of sensors for detecting the indicia in the first track and producing an N-bit output representative of a coarse elevator position. The second track has spaced indicia forming a fine scale between successive coarse code positions on the first track, and a second set of sensors detects the fine code indicia and produces fine code position information at successive points between each pair of coarse code positions as the sensors traverse the tape.

14 Claims, 5 Drawing Sheets

| TAPE TRAVEL (X 3/32 INCHES) | | DECODED BINARY VALUE 6 | 7 | 0 | 1 | 2 | 3 | 4 | 5 | 6 |
|---|---|---|---|---|---|---|---|---|---|---|
| GRAY | CLK 3 | 0 | 0 | 1 | 1 | 1 | 1 | 0 | 0 | 0 |
| | CLK 4 | 0 | 1 | 1 | 1 | 1 | 0 | 0 | 0 | 0 |
| | CLK 1 | 0 | 0 | 0 | 0 | 1 | 1 | 1 | 1 | 0 |
| | CLK 2 | 0 | 0 | 0 | 1 | 1 | 1 | 1 | 0 | 0 |
| BINARY | $2^2$ | 1 | 1 | 0 | 0 | 0 | 0 | 1 | 1 | 1 |
| | $2^1$ | 1 | 1 | 0 | 0 | 1 | 1 | 0 | 0 | 1 |
| | $2^0$ | 0 | 1 | 0 | 1 | 0 | 1 | 0 | 1 | 0 |

ELEVATOR POSITION SENSING SYSTEM USING CODED VERTICAL TAPE

BACKGROUND OF THE INVENTION

The present invention relates generally to a system for sensing the position of an elevator in an elevator shaft in order to allow accurate control of elevator movement and stopping at selected floors. The position information can be used in conjunction with an elevator control system which controls elevator car movement according to input from the sensing system.

Various elevator position sensing systems have been proposed in the past for providing elevator position information to an elevator controller. Some of these systems involve running a coded tape along the length of the elevator shaft and mounting suitable sensors on the elevator car for sensing holes in the tape, for example, and using the sensed hole position to derive elevator position information. Where these systems are reliant on incremental counting from a detected floor position, loss in power to the system results in loss of the collected position data. Additionally, some of the known systems do not provide sufficient accuracy in the detected position information. Some of these problems can be overcome or reduced by a system which determines absolute position of a car in a hoist way or elevator shaft.

One absolute position measurement apparatus is described in U.S. Pat. No. 3,963,098 of Lewis, et al. In this apparatus a tape is provided with two tracks of punched holes arranged to form a digital code in each direction. The code is selected to provide, for any N consecutive bits of data, a bit pattern which is unique and thus which can be used to derive elevator position information. A tape reader on the elevator car reads at least 16 consecutive bits defined by the indicia disposed immediately adjacent the car, and the bit pattern is translated into a car location. The tape reader includes a pair of readers for each track, for reading the information when the car is moving up and when the car is moving down, respectively.

U.S. Pat. No. 4,433,756 of Caputo, et al. describes an elevator system in which a tensioned tape is provided with informational data in two tracks, one of the tracks having a series of uniformly spaced openings and the other track having both uniformly spaced openings and a binary code. The uniformly spaced openings in the second track separate the code into 16-bit increments, and are used to generate a 5 position reading each time 16 consecutive bits of data have been collected. Between these positions, car position is determined by incrementing the car position reader each time an interrupt is provided by the readers directed at the first track. This is susceptible to loss of information in the event of a power failure, and also has an accuracy limited to the spacing between the holes in the first track.

SUMMARY OF THE INVENTION

It is an object of this invention to provide a new and improved absolute position sensing system for an elevator.

According to the present invention, an elevator position sensing system is provided which comprises a tape vertically mounted in an elevator shaft and having two parallel tracks of indicia running along its length, the first track of indicia comprising a pseudo-random code sequence having N-bit code element length which is non-repeating for any N consecutive bits along the length of the tape, and the second track comprising a series of equally spaced indicia, and a sensor unit mounted on the elevator car having first and second sets of sensors aligned with the respective tracks, the sensors comprising means for detecting the indicia in each track and providing a corresponding sensor output. Suitable output circuitry is provided for detecting the sensor output signals and converting them to elevator car position data for transmission to the elevator motor microprocessor controller.

In the preferred embodiment of the invention, the first track of indicia and associated sensors produces, for any N successive bits, a unique N-bit output each time the sensors traverse one-bit length of the tape, the output representing a coarse elevator position at an accuracy equivalent to the spacing between any two successive bits in the code. The second track of indicia and associated sensors are set up to produce eight bits of fine position data between each detected coarse position, in other words producing a unique code output for a series of equally spaced positions between each N-bit coarse position and the next position on the coarse code track, in the manner of a Vernier scale. Preferably, four sensors are associated with the fine code track and are positioned such that their outputs produce a so-called Gray code, for which only one bit changes at a time as the sensors traverse the tape. This means that any error in reading the output from these sensors can only produce an error amount equal to the spacing between successive fine code positions ($\frac{1}{8}$0 of a coarse bit), and therefore reduces the risk of ambiguous readings and improves accuracy.

The first set of sensors includes at least N sensors so that N data bits can be read simultaneously to describe any unique position along the coded tape. Preferably, double this number is provided to allow edge discrimination, with the sensors being placed alternately in a single column to produce an array that is BABABA.....BA and 2N sensor elements long. One sensor in the second set is used to determine whether the output of the A or B set of sensors in the first set is used, depending on which set is approximately centered on the coded indicia.

This arrangement can permit elevator car position to be determined to an accuracy of better than 0.1 inches.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

The elevator position sensing system of this invention is designed for installation in an elevator shaft and for integration with an elevator controller of the relay or microprocessor type. The system is designed to produce output signals representative of the absolute position of the elevator car in the shaft, for coupling to a typical elevator controller for controlling elevator speed, direction and positioning.

Figure 2:
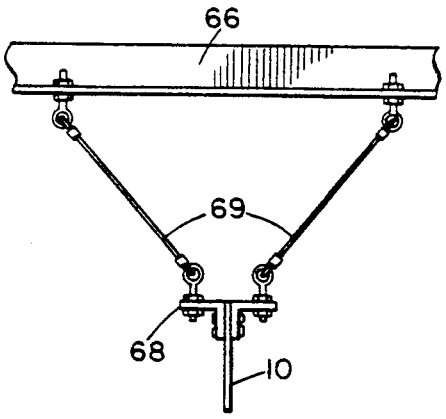
FIG. 2 is an enlargement of the upper end of the tape attachment.
Figure 3:
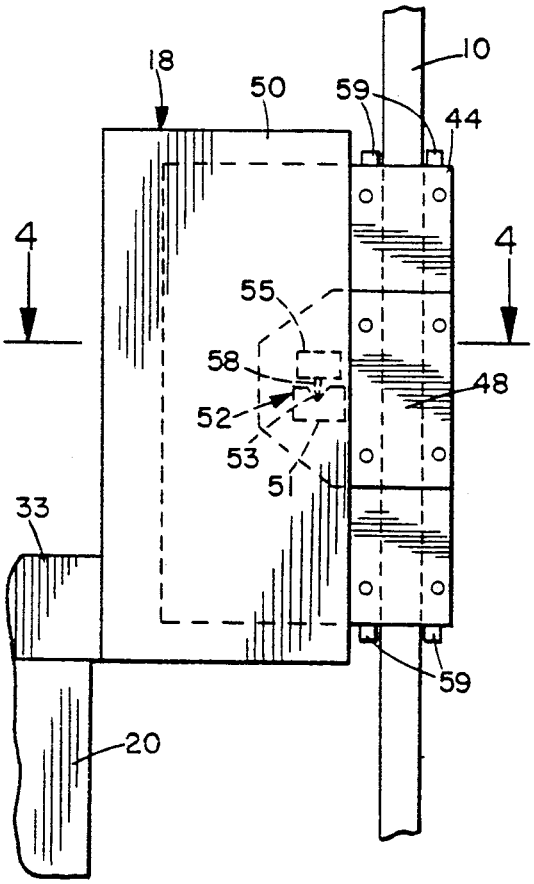
FIG. 3 is an enlarged view from the side of the tape sensor assembly.
Figures 4, 8:
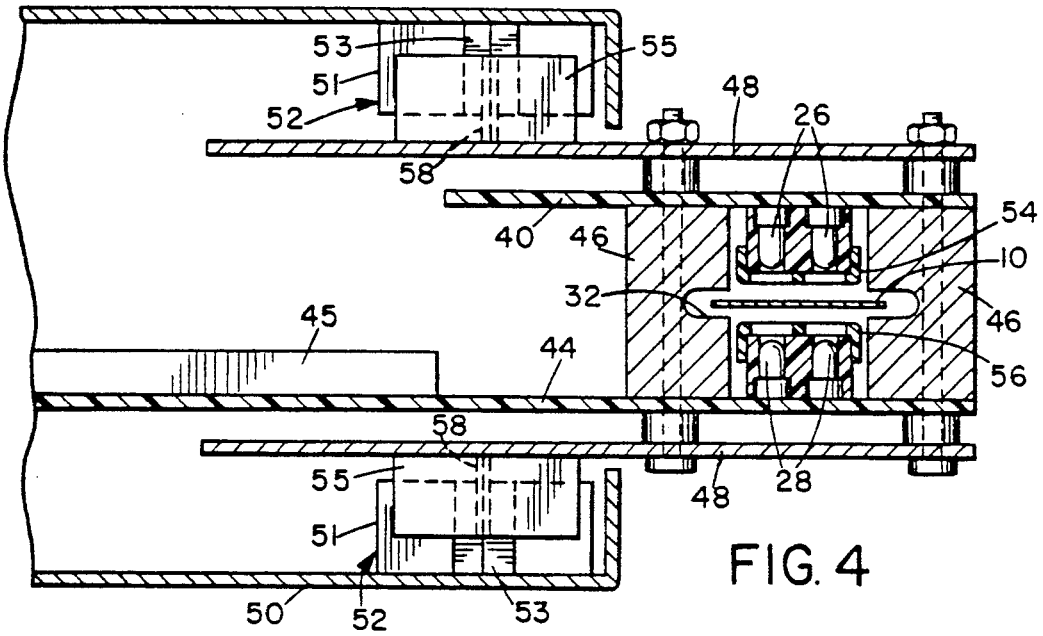
FIG. 4 is an enlarged sectional view taken on line 4—4 of FIG. 3.
FIG. 8 is a table illustrating successive outputs from the four fine code track sensors and their conversion into corresponding binary output signals.

As best illustrated in FIGS. 1 to 6, the system basically comprises a tape 10 carrying two tracks 12,14 of coded indicia which is installed vertically in the elevator shaft or hoist way 16, and a sensor assembly or unit 18 which is suitably mounted on the elevator car 20 for detecting indicia on the tape 10. In the preferred embodiment of the invention, the indicia in the respective track on the tape are in the form of respective holes 22, 23 and respective non-holes 24, 25. The sensor unit contains two sets of sensors 34, 36 aligned with the respective tracks on the tape. Each sensor of each set 34, 36 comprises a suitable opposing pair of light emitters such as LEDs 26 and light detectors such as photocells 28 on opposite sides of the tape, as illustrated in FIG. 4.

Figure 5:
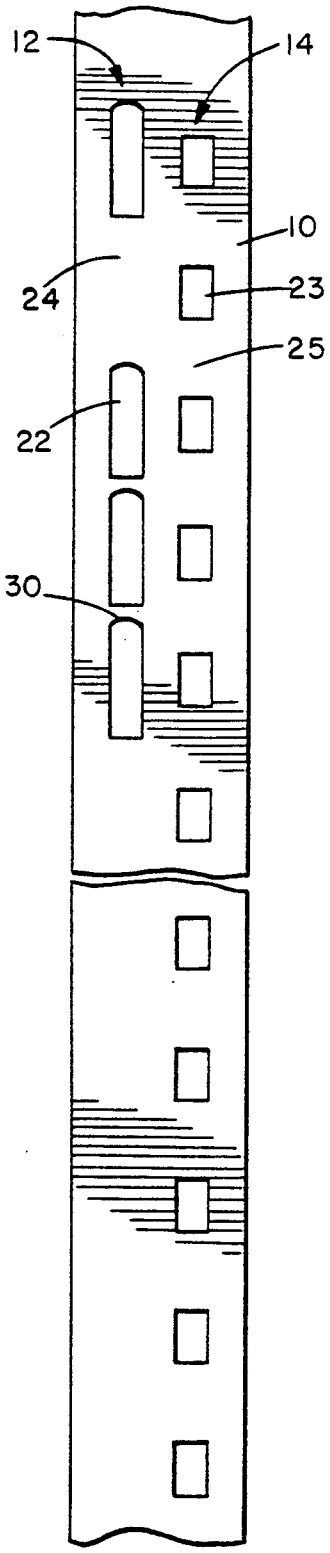
FIG. 5 illustrates a portion of the coded tape.

A short section of the tape with the side by side parallel coarse and fine code tracks 12 and 14 is illustrated in FIG. 5. The first track 12 of coded indicia carries coarse code data in the form of a pseudo-random code which is non repeating for any N successive bits of the code along the entire length of the tape. A serial pseudo-random code of $2^N$ bits in length has the property that there are $2^N$ successive N-bit groups along the length of the code. If N is selected to be 14, and with a selected bit spacing of 0.75 inches between successive bits of the code, the code will be nonrepeating for a total length of $2^{14} \times 0.75/12$ or 1,024 feet. Thus, this arrangement can be used to provide absolute position information to an accuracy of 0.75 inches in an elevator hoist way of up to 1,024 feet in height. Clearly, different length codes and bit spacings may be selected in other embodiments. Each hole was selected to have a length of 0.665 inches in one example, with a bit center-to-center spacing of 0.75 inches.

The pseudo-random code for the first track 12 is generated by a linear feedback shift register or equivalent computer emulation of the shift register sequences. The generation of pseudo-random codes is described in "Shift Register Sequences" by S. W. Golomb, Holden-day, Inc. 1967, sections 2.1, 2.4 and 4.2. Once the code has been generated, it is stamped along the first code track in the tape with successive bits at the selected spacing, in this case 0.75 inches, by a punch and die set on a microprocessor controlled punch press. Simultaneously, the second track 14 is stamped in the tape. The second track is in the form of a series of equally-spaced holes 23 and non-holes 25 which are designed to generate fine position information in the manner of a Vernier scale, as will be explained in more detail below. The center to center spacing between successive holes 30 in the fine code track is also 0.75 inches, and each hole has a length of 0.338 inches. Each hole in the second track is centered on a data bit, either hole or non-hole, in the first track.

In one preferred embodiment of the invention, tape 10 was a one inch wide steel tape. An air operated punch feed was used to feed the tape in 0.75 inch increments. At each incremental position, the coarse and fine code information was punched under control of the tape punch microprocessor controller, in which the pseudo-random code information previously generated was stored. The data sequence stored determines whether or not a hole 22 is to be punched in the coarse code track at any incremental position. As illustrated in FIG. 5, the holes 22 in the coarse code track are rounded at one end 30. This enables the installer to distinguish between the top and bottom ends of the tape, with the tape always being installed with the rounded slot ends 30 pointing towards the top of the elevator.

Figure 1:
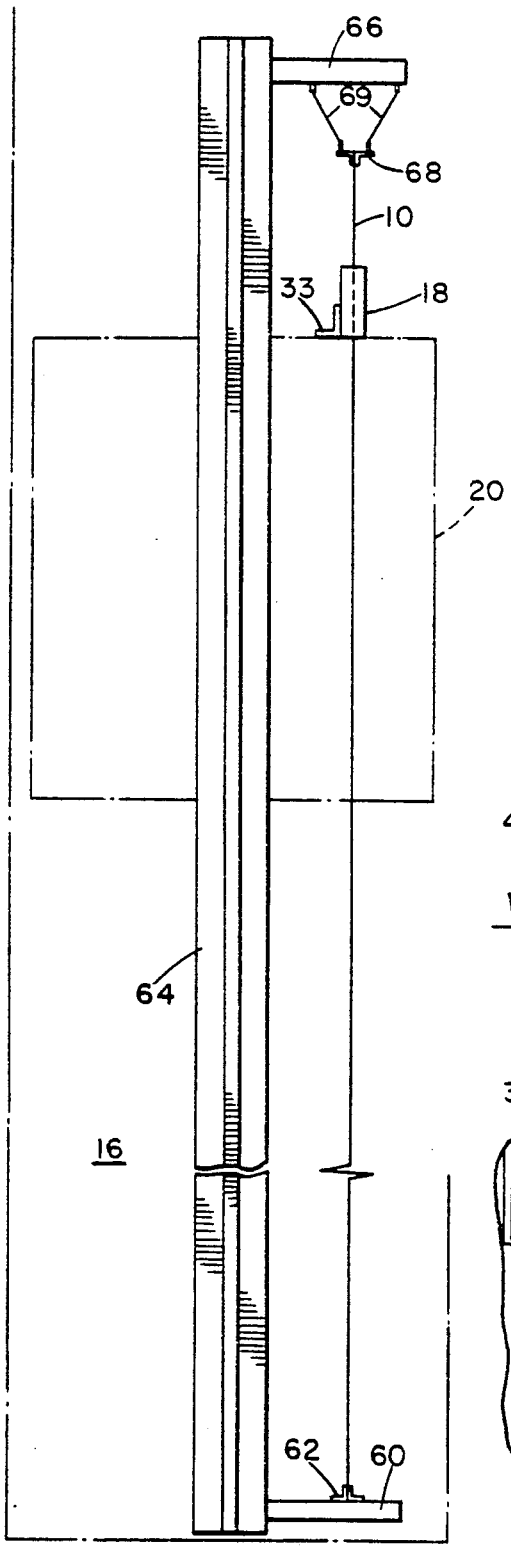
FIG. 1 is a side elevation view of an elevator installation with a position sensing system according to a preferred embodiment of the invention, showing the position of the coded tape.
Figure 6:
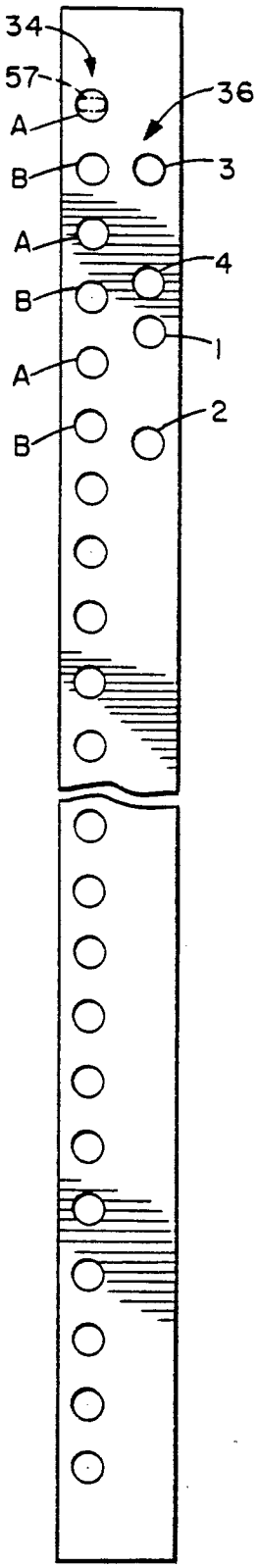
FIG. 6 illustrates the layout of the sensors in the tape reader head.

Once the tape has been prepared by stamping the two parallel code tracks 12 and 14, it is mounted vertically in the elevator shaft so that it extends through a suitable guide channel or slot 32 extending through the sensor unit 18 mounted on the elevator car top bracket 33, as illustrated in FIGS. 1, 3 and 4. First and second sets of sensors 34,36 are vertically arranged in parallel columns in the sensor unit as illustrated in FIG. 6, the sensors facing across channel 32 in alignment with the respective code tracks 12 and 14, as indicated in FIGS. 4 and 6. FIG. 6 shows the layout of the second set of sensors 36 relative to the first set of sensors 34. The LEDs 26 of each set of sensors are mounted on a first printed circuit board 40 on one side of the channel, while the opposing photo transistors 28 of each set are mounted on a second printed circuit board 44 on the opposite side of the channel, as best illustrated in FIG. 4. The first circuit board 40 carries all the LEDs and the driving circuitry (not illustrated) while the second circuit board carries all the photo-transistors and the output logic circuitry 45, to be described in more detail below.

The circuit boards 40,44 are connected by spacer members 46 which define the tape guide channel, and are secured via respective outer side plates 48 in an outer box or housing 50 mounted on bracket 33 and projecting out to one side of the elevator car as best illustrated in FIG. 3. The side plates are flexibly mounted to the housing 50 via a knife edge joint 52, as best illustrated in FIGS. 3 and 4. Joint 52 comprises pivot block 51 each having an upwardly directed V-groove 53 and secured on respective opposite sides of housing 50, and opposing blocks 55 each having a downwardly directed knife edge blade 58 secured on the outer sides of the respective side plates 48. The knife edges 58 seat firmly into the opposing V-grooves 53 in the respective pivot blocks. With this arrangement, if the car rocks or rotates in the hoistway, the pivot mounting allows the sensor assembly to stay vertical, as guided by the vertically running tape 10 and guide pads 59 at opposite edges of the tape at the upper and lower end of the sensor assembly, as illustrated in FIG. 3. This allows the sensor unit to track the tape if the car rocks from a true vertical position and keep the tape centered in the guide channel, avoiding extreme pressure on the tape guides and reducing wear.

A slotted mask 54,56 extends over both the LED and photo transistor arrays to align and separate the devices, keeping stray radiation away from adjacent photo transistors. Each mask has slots 57 centered on the respective sensors in each set, the slots extending in two parallel tracks aligned with the respective sensor sets and coded tape tracks. The slots are arranged in parallel and are relatively narrow, having a width of the order of 0.063 inches. The dimensions of a slot relative to an LED are illustrated in FIG. 6.

FIGS. 1 and 2 illustrate the manner of suspending the tape 10 in the hoist way. The tape is mounted to a bottom channel 60 via brackets 62, and the bottom channel is mounted to the main guide rail 64. The top end of the tape is suspended from a top channel 66, also mounted on the guide rail 64. The top end of the tape is secured between brackets 68 which are suspended in a trapeze-like fashion via two cables 69 from the top channel 66. This arrangement prevents twisting of the tape while allowing some degree of lateral movement, to reduce wear in the sensor unit tape guides, which would otherwise be a problem particularly when the elevator car is at the top of the hoistway.

Figure 7:
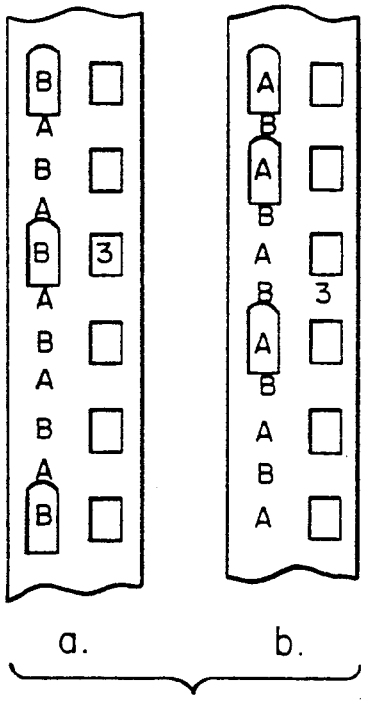
FIG. 7 illustrates two positions of the sensors relative to the coded tape for determining which sensor outputs are used in computing elevator position.

The sensor arrangement for generating information from the two coded tape tracks will now be described in more detail, with reference to FIGS. 5, 6 and 7. With a 14-bit pseudo-random code, 14 data bits must be read to describe any unique position or data word along the coarse code data track 12, so the first set of sensors aligned with this track must include at least 14 LED/-photo transistor sensor pairs at a separation of 0.75 inches between each adjacent pair of sensors. In this system, a punched hole in the tape represents a "0" while no hole represents a "1". However, with only 14 sensors there is a measurement error which can result when reading bits which are at transition points between a "1" and a "0" (i.e., at the end of a hole). In order to reduce or eliminate such ambiguities, the first set of sensors comprises 28 (2xN) sensor pairs at a spacing of 0.375 inches. These are electrically divided into two groups called group A and group B, and are placed alternately in the sensor unit in a single column to make an array that is 28 elements long and arranged BABABABA....BABA, as indicated in FIG. 7.

The second set of sensors for generating the fine position information between successive coarse code positions comprises a vertical column of four LED/-photo transistor sensor pairs, which are numbered 1 to 4 in FIG. 6. As illustrated in FIGS. 6 and 7, sensor number 3 of the second set comprises a discrimination sensor which is aligned with one of the B group sensors in the first set. This arrangement is used to determine which group of the first sensors, A or B, is used by the control circuitry to produce the position information at any instant. All 28 sensors are read each time and stored but only 14 are converted to binary (either A or B) as determined by sensor 3. It can be seen from FIG. 5 that the arrangement of the uniformly spaced holes in the second code track is such that they are centered on bit positions (hole or no hole) in the first track, while the gaps or no holes are centered on the transition points in the second track. Thus, as illustrated in FIG. 7*a*, when the sensor pair 3 is detecting a hole between them, the B set of sensors is centered on the bit position in the first track and thus the system is signaled to use all 14 B sensors to obtain the position data. When sensor pair 3 is detecting "no hole", as in FIG. 7*b*, the A set of sensors is centered on the bit positions while the B set is located at the edge or transition. Thus, the system is signalled to use all 14 A sensors to obtain the position data. It can be seen that this technique allows only the sensor group that is currently located at the middle of the successive data elements or bits to be used in generating elevator position information, eliminating reading ambiguities. This technique is similar in principal to V or U scan techniques used in brush-type encoders to prevent measurement ambiguities.

In addition to discriminating between which group of sensors, A or B, to be used to generate the coarse position information, the second set of four sensors is also used to generate a Gray coded output which can be converted to a 3-bit binary code representative of fine or vernier positions between successive coarse positions along the 0.75 inch spacing between any two successive 14-bit coarse code positions. The problem of reading ambiguities in the fine code track is solved by having four sensors, rather than three, to produce the fine position information, using a coding scheme as illustrated in FIG. 8 which is similar to so-called Gray code or reflected binary. The sensor pairs 4, 1 and 2 are spaced at 21/32 inches, 30/32 inches, and 51/32 inches, respectively from the sensor pair 3, as illustrated in FIG. 6, and when these sensors travel along the fine code tape track they will produce eight successive 4-bit Gray code outputs as illustrated in FIG. 8 at 3/32 inch (0.09375 inch) intervals along each ¾ inch section of the track (each "1" and "0" of the fine code track). The Gray code repeats itself each 0.75 inches, thus dividing each 0.75 inch length (length of one hole plus one no-hole) of the repeating fine code track U into eight sections, each 3/32 inches long. Each time the fine code changes from a 7 to a 0 or a 0 back to a 7, the coarse code value goes up or down by one unit (0.75 inches), respectively. Between those positions, the fine code position sensors produce a series of unique code outputs representing a fine scale at intervals of 3/32 inches between the successive coarse code unit positions. For example, an output from the fine scale sensors corresponding to a binary 2 represents an amount of $2\times3/32$ inches to be added to the coarse code position value, as illustrated in FIG. 8, which illustrates the fine positions between each coarse code position as detected by the fine code sensors 1 to 4 as the sensors travel along the fine code track 14.

It will be noted that the holes, or "0"'s of the fine code track are shorter than the no-holes, or "1"'s. The hole and no-hole lengths are 0.338 and 0.412 inches, respectively. This is because, if the hole and no-hole were of equal lengths, the output would be non-symmetrical due to edge effects. As noted above, each LED and photo-transistor pair are covered by a slotted mask. As soon as a hole in the tape begins to uncover the slot for one sensor pair, the transistor will turn on, and it will not turn off until less than half of the slot is uncovered. Thus, the sensor will be on for a longer period than it is off if the holes and gaps are of equal length. By reducing the length of the holes, the off and on times can be made equal.

The advantage of the Gray code output is that only one bit in each of the four Gray code bits changes at a time as the sensors traverse the tape, as can be seen in FIG. 8, so that any error in the reading can only be off by 3/32 inches at most. A suitable programmable logic device can be used to convert the 4-bit Gray code into the equivalent 3-bit binary code representing the three least significant digits of the generated position information, as illustrated in FIG. 8. This will be discussed in more detail below.

The converted binary code from the second set of sensors is a fine or vernier code to the 14-bit coarse code from the first set of 14 sensors, A or B. Therefore, a 1,024 foot length of coded tape is actually divided into $2^{17}$ parts, comprising 14 bits of coarse data from the first track and three bits of fine data from the second track.

Figure 9:
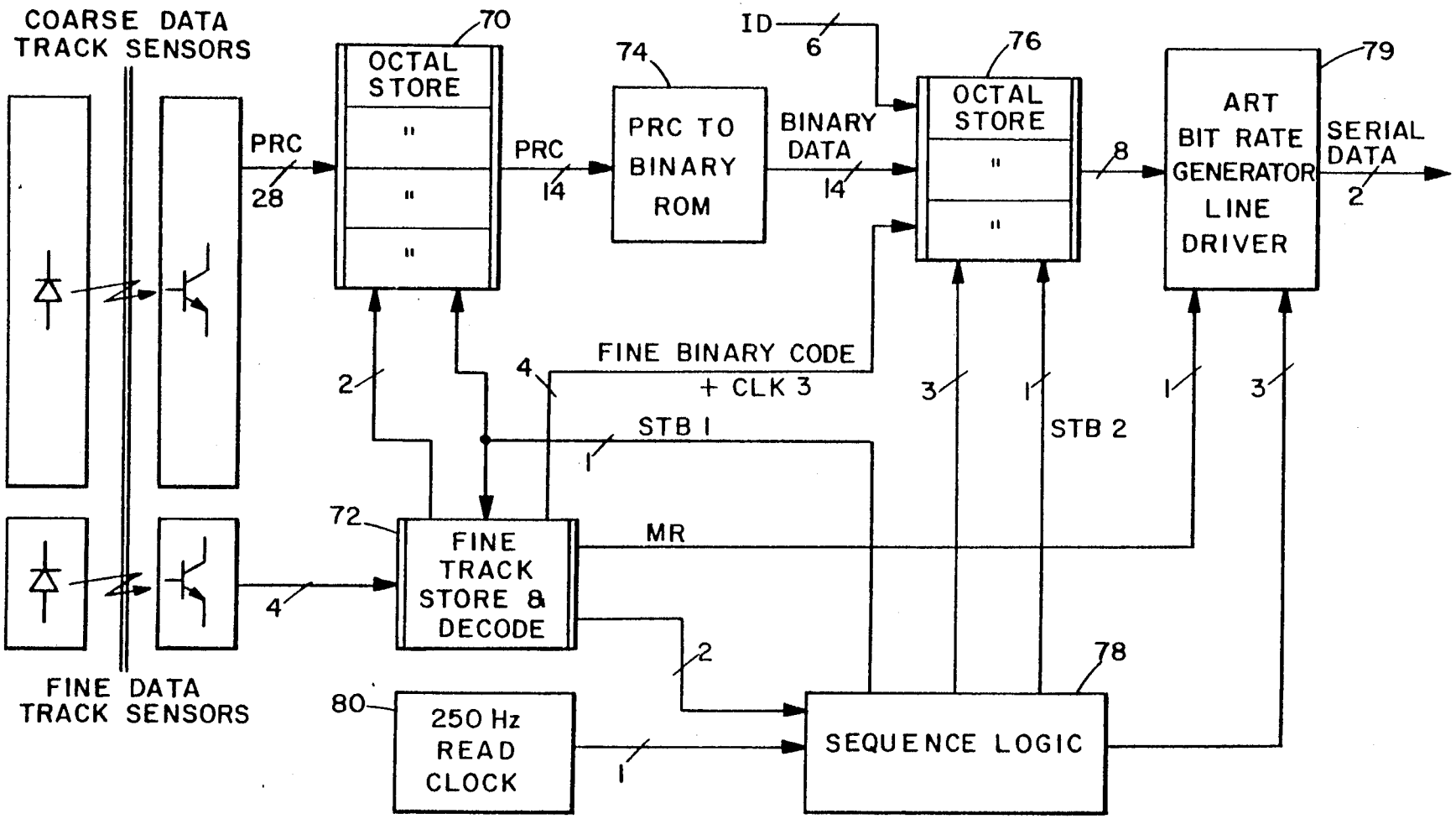
FIG. 9 is a block diagram of the output system for detecting the sensor outputs and producing corresponding elevator position information signals for connection to an elevator controller for controlling elevator movement.

FIG. 9 is a block diagram of the output circuitry which collects and stores the output signals generated by the sensors and which converts the outputs to serial data representing the absolute elevator position at equal time intervals for transmission to an elevator microprocessor controller. The outputs from all 28 of the first track sensors are stored in an octal store 70, along with six ID bits, while the outputs from the four fine track sensors are connected to a storage and decoding unit 72, which converts the 4-bit Gray code to binary. Decoding unit 72 may comprise a field programmable logic array (FPLA), for example, such as an 82S153 FPLA. The 3-bit binary code is transmitted to the octal store 76. The sensor 3 state information for discriminating between the A and B sensors is fed to octal store 70. The status of the sensor 3 determines which 14-bit group of coarse code (A or B) is gated to ROM decoder unit 74. The ROM decoder converts the 14-bit coarse code into a 14-bit binary position value according to stored conversion data, and transmits this along with the 3-bit binary fine position information from the fine track store decode 72 to a second octal store 76.

As has been discussed previously, each one-bit incremental position along the coarse code track represents a unique 14-bit pseudo-random code element or word, and these positions occur at 0.75 inch intervals along the tape. There are $2^{14}$ unique I4-bit code words along an encoded tape. Each of these unique pseudo-random words are convertible to an u equivalent 14-bit binary number. A decoder 74, consisting of 2 256K EPROMS ($32\times8$ bits), is used to store the $2^{14}$ binary coarse code numbers. When addressed by a unique 14-bit pseudo-random number, decoder 74 outputs corresponding binary data representing the actual distance along the tape. After installation, the tape can be calibrated to provide indexing between the tape position and the floor landings, and the tape position corresponding to each floor and any other location of interest can be stored.

Figure 10:
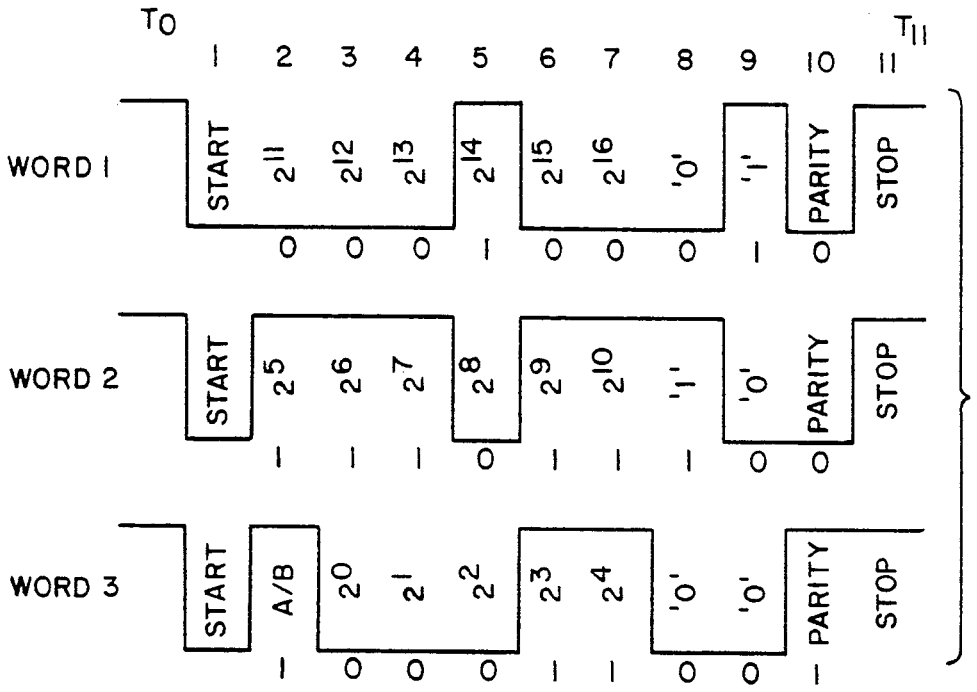
FIG. 10 is a table illustrating a typical sequence of output information for a particular elevator position provided by the circuit of FIG. 9.

The second set of octal registers 76 store the 14-bit binary coarse position information ($2^3$ to $2^{16}$),the 3-bit fine position information ($2^0$ to $2^2$), along with six ID bits and the sensor 3 state, in other words a total of 24 bits. A sequence logic unit 78 controls the reading of the data into the second set of registers 76 via a read pulse STB2, while enable pulses from the sequence logic provide eight bits at a time from these registers to UART unit 79. In UART unit 79 the 24 bits of stored data in octal store 76 are converted into three 8-bit serial words, with a format as illustrated in FIG. 10, for transmission to an elevator controller.

Figure 11:
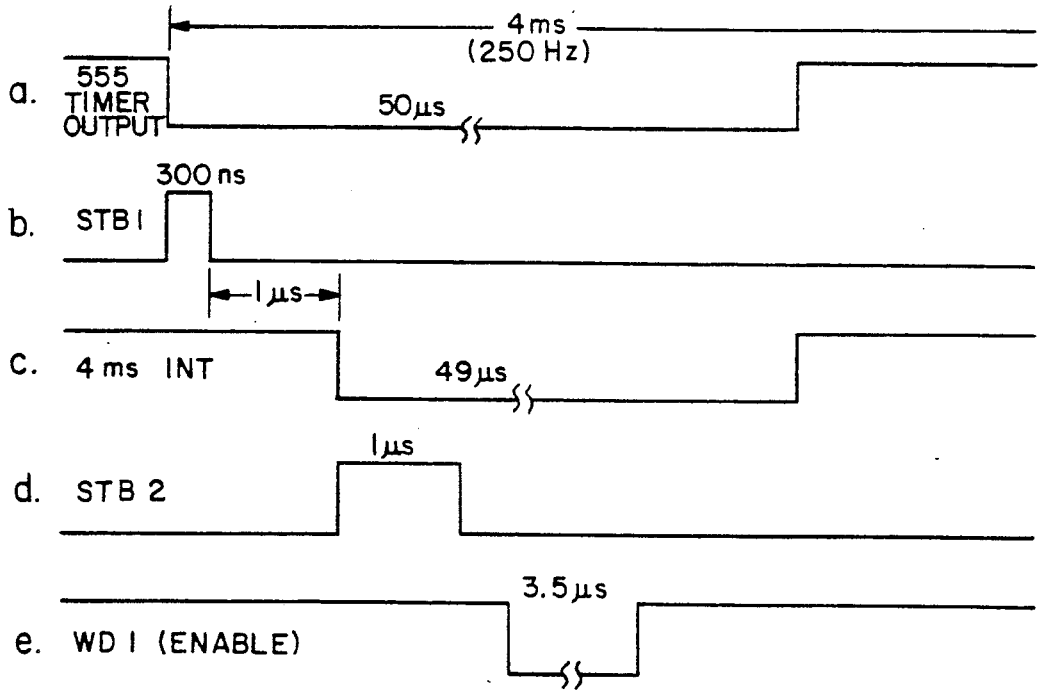
FIG. 11 is a timing diagram of the output circuitry.

A 250 Hz clock generator 80 continually interrogates the sequence logic to produce one strobe read pulse STB1 every 4 ms as illustrated in the timing diagram of FIG. 11. A position reading is taken from the sensors every 4 ms in response to the read pulse, which clocks the 32 bits of information into the storage registers 70 and 72, which are preferably 74HC574 octal storage registers. The output lines of the registers 70 are bussed together so that, depending on the state of the sensor 3, either the A or B position data will be present on the output from these registers, which are the 14 output lines representing the $2^3$ to $2^{16}$ bits The output lines $2^3$ to $2^{16}$ from the first set of octal registers 70 contain pseudo-random coded data, which must be converted to binary before it can be used. The binary converter 74 contains two 256K EPROMS which convert the coded data to binary form. A second strobe pulse, delayed 300 ns from the first pulse STB1, clocks the binary position information into the three octal registers 76, along with the three bits of fine position information, the A/B bit, and the six ID bits. These three registers contain the bits that will make up the three words to be transmitted to the elevator controller. Word enable lines Wd1, Wd2 and Wd3 from the sequence logic sequentially enable the registers putting eight bits at a time on the bus to the UART unit. The timing sequence is illustrated in FIG. 11. Clock 80 comprises a 555 Timer chip which generates a 50 us pulse at a 250 Hz rate as illustrated at the top of FIG. 11. From this pulse, the 300 ns STB1 pulse is generated at 4 ms intervals. Also, a 49 $\mu$s interrogate pulse INT is generated, which is delayed 1 $\mu$s from the initial timer output pulse, and this pulse is fed to the field programmable logic sequencer, which may comprise an 82S105 FPLS or equivalent. The FPLS in turn generates the 1 $\mu$s STB2 pulse, which enables the binary EPROM to output data into the storage registers, as described above. Following STB2, a 3.5 $\mu$s long Wd1 enable pulse is generated by the FPLS, which is followed by Wd2 and Wd3 pulses to enable words 2 and 3 for transmission to the elevator controller. The three 8-bit words as in FIG. 10 are sent out before the next read pulse occurs. The UART unit contains circuitry to convert the stored data from the octal registers into the three 8-bit serial words in the format of FIG. 10, and also contains a differential line driver meeting EIA standard RS-422 for two wire transmission of the three word position data. The logic sequencer communicates with the UART unit, which may be an AY-5-1013A UART, to transmit the data via the line driver, which may comprise a SN75176 line driver, for example.

As described above, the combined code length of the coarse and fine code tracks is 217 bits at 0.09375 inch intervals over a 1024 foot length of tape, and the effective resolution is 0.09375 inches per bit (0.75/8), or better than 0.1 inches. The information illustrated in FIG. 10 represents the UART unit serial output for the 18168 position value on the tape, in other words $18168\times0.09375/12$ feet up the tape from a starting point of 0 at the bottom, or 141.9375 feet up the tape. The decoded position information may be serially transmitted to the elevator microprocessor controller prior to conversion into binary form, or may be converted first into binary before being serially transmitted, as illustrated in FIGS. 9 and 10. The decoded position information is continually transmitted in serial form to the controller at 4 ms intervals.

This arrangement produces very accurate and reliable absolute elevator position information which can be used in conjunction with an elevator controller in driving a car to a selected location. With this system, a car can be positioned to within 0.125 inches of a particular floor.

Although a preferred embodiment of the invention has been described above by way of example only, it will be understood by those skilled in the field that modifications may be made to the disclosed embodiment without departing from the scope of the invention, which is defined by the appended claims.

We claim:

1. An elevator position sensing system, comprising:

a tape vertically mounted in an elevator shaft;

the tape having two parallel tracks of indicia running along its length, the first track of indeicia consisting of a pseudo-random code sequence only, the code sequence having a code element length of N bits which is non-repeating for any N consecutive bits along the length of the tape and which represents a coarse elevator position for any N consecutive bits, and the second track comprising a series of equally spaced indicia;

a sensor unit mounted on the elevator car having first and second sets of sensors aligned with the respective tracks, the sensors comprising means for detecting the indicia in each track in parallel and producing a corresponding sensor output;

output means connected to the sensor unit for detecting the sensor output signals and converting them to elevator car position data for connection to an elevator controller;

the first track of indicia and corresponding set of sensors comprising means for generating coarse elevator position coded output at successive one-bit intervals and the second track of indicia and correspondign set of sensors comprise means for generating fine elevator position information between each N-bit coarse position coded output.

2. The system as claimed in claim 1, wherein there are 2N equally spaced sensors aligned with said first track at a spacing of half the distance between successive indicia in the track, the sensors comprising alternating A and B sensors, and the sensor unit further includes discriminator means for detecting which of the A and B groups of sensors is centered on the indicia in the first track, said output means being responsive to the output from said discriminator means to read the output from the centered group of sensors to determine the coarse elevator position.

3. The system as claimed in claim 2, wherein the second set of sensors aligned with the second track comprise means for generating a series of coded outputs representing successive fine scale positions between each pair of successive coarse code positions in the first track.

4. The system as claimed in claim 3, wherein the second set of sensors comprise four spaced sensors for generating successive 4-bit Gray code values at successive positions in which only one bit of the 4-bit Gray code changes between successive incremental positions, said output means further comprising means for decoding said Gray code outputs and converting them to a three digit binary value.

5. An elevator position sensing system, comprising:

a tape vertically mounted in an elevator shaft;

the tape having two parallel tracks of indicia running along its length, the first track of indicia comprising a pseudo-random code sequence having an N-bit code length which is non-repeating for any N successive bits along the length of the tape, and in which each N-bit length of code represents a coarse elevator position, the spacing between successive coarse elevator positions being equal to the spacing between successive bits in the code;

the second track of indicia comprising a fine code track for generating fine position information between successive coarse elevator positions in the first track;

a sensor unit mounted on the elevator car having first and second sets of sensors aligned with the respective first and second tracks of indicia for detecting the indicia in each track and for producing corresponding coarse and fine code output signals as the sensor unit moves along the tape, the first set of sensors comprising means for producing an N-bit coarse position code output each time the unit traverses one-bit length of the first track; and output means connected to said sensor outputs for detecting said output signals and converting them to elevator car position data for transmission to an elevator controller at predetermined intervals.

6. The system as claimed in claim 5, wherein the second track of indicia comprise uniformly spaced indicia, and the second set of sensors comprise means for producing a predetermined sequence of fine code position outputs at a series of incremental positions between each coarse elevator position in the first track.

7. The system as claimed in claim 6, wherein the second set of sensors comprise four sensors at predetermined spacings for producing a 4-bit Gray code output in which only one bit changes at a time between each successive incremental position as the sensor traverses the tape.

8. The system as claimed in claim 5, wherein there are at least N sensors in the first set at equal spacings corresponding to the bit spacing in the first track for producing an instantaneous N-bit coded output at each coarse code position in the first track.

9. The system as claimed in claim 8, wherein the first mentioned N sensors in the first set comprise A sensors and there are an additional group of N sensors comprising B sensors alternating with the A sensors, each B sensor being spaced midway between a respective adjacent pair of A sensors, and the sensor unit includes discriminator means for determining which of the A and B group of sensors is approximately centered on the indicia at any position, the output means being responsive to said discriminator means for selecting the outputs of the sensor group which is centered on the indicia for conversion to elevator position information.

10. The system as claimed in claim 9, wherein said discriminator means comprises a sensor in the second set which is aligned with a B sensor in the first set.

11. The system as claimed in claim 5, wherein the tape comprises a metallic tape.

12. The system as claimed in claim 5, wherein said indicia comprise spaced holes, and said sensors comprise means for detecting the presence or absence of a hole and producing corresponding output signals.

13. The system as claimed in claim 12, wherein the holes are of generally rectangular shape and the holes in at least one of the tracks are rounded at one end only.

14. The system as claimed in claim 13, wherein each successive hole in the second track is centered on successive data bits in the first track.

* * * * *

UNITED STATES PATENT AND TRADEMARK OFFICE

CERTIFICATE OF CORRECTION

PATENT NO. : 5,135,081

DATED : August 4, 1992

INVENTOR(S) : Richard E. Watt, et al.

It is certified that error appears in the above-identified patent and that said Letters Patent is hereby corrected as shown below:

Column 9, Line 46, change "2" to --1--

Column 10, Line 63, change "13" to --12--

Signed and Sealed this

Sixteenth Day of November, 1993

*Attest:*

*Attesting Officer*

BRUCE LEHMAN

*Commissioner of Patents and Trademarks*